US007561136B2

(12) United States Patent
Hong et al.

(10) Patent No.: US 7,561,136 B2
(45) Date of Patent: Jul. 14, 2009

(54) METHOD AND APPARATUS FOR DRIVING LIQUID CRYSTAL DISPLAY PANEL

(75) Inventors: Jin Cheol Hong, Kyoungsangbuk-do (KR); Sang Rae Kim, Kyoungsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 631 days.

(21) Appl. No.: 10/873,244

(22) Filed: Jun. 23, 2004

(65) Prior Publication Data

US 2004/0263447 A1 Dec. 30, 2004

(30) Foreign Application Priority Data

Jun. 24, 2003 (KR) ..... 10-2003-0041126

(51) Int. Cl.
*G09G 3/36* (2006.01)

(52) U.S. Cl. ..... 345/98; 345/211; 345/94

(58) Field of Classification Search ..... 345/92, 345/94, 211, 90, 98; 349/114, 153, 140, 349/149

See application file for complete search history.

(56) References Cited

U.S. PATENT DOCUMENTS

| | | | | |
|---|---|---|---|---|
| 4,955,697 | A * | 9/1990 | Tsukada et al. | 345/92 |
| 5,526,012 | A * | 6/1996 | Shibahara | 345/94 |
| 5,663,743 | A * | 9/1997 | Fujii et al. | 345/211 |
| 5,995,074 | A * | 11/1999 | Kusafuka et al. | 345/90 |
| 6,288,765 | B1 * | 9/2001 | Tanaka et al. | 349/153 |
| 6,452,654 | B2 * | 9/2002 | Kubo et al. | 349/114 |
| 7,038,675 | B2 * | 5/2006 | Kawamura et al. | 345/211 |

* cited by examiner

*Primary Examiner*—Kevin M Nguyen
(74) *Attorney, Agent, or Firm*—Birch, Stewart, Kolasch & Birch, LLP

(57) ABSTRACT

A method and apparatus for driving a liquid crystal display panel results in minimizing the deterioration of picture quality caused by a variation in the gate low voltage. A liquid crystal cell matrix is defined by intersections between gate lines and data lines. In the apparatus, a gate driver applies a gate high voltage to the gate lines in a corresponding first period, a first gate low voltage independent from other gate lines to the gate lines in the next second period, and a second gate low voltage depending on other gate lines to the gate lines in the next third period.

21 Claims, 8 Drawing Sheets

METHOD AND APPARATUS FOR DRIVING LIQUID CRYSTAL DISPLAY PANEL

This application claims the benefit of the Korean Patent Application No. P2003-41126 filed in Korea on Jun. 24, 2003, which is hereby incorporated by reference.

BACKGROUND OF THE INVENTION

1. Field of the Invention

This invention relates to a liquid crystal display, and more particularly to a method and apparatus for driving a liquid crystal display panel can minimize the deterioration of picture quality caused by variations in the gate low voltage.

2. Description of the Related Art

Generally, a liquid crystal display (LCD) controls the light transmittance of a liquid crystal having a positive or negative dielectric anisotropy by using an electric field. To this end, the LCD includes a liquid crystal display panel for displaying a picture, and a driving circuit for driving the liquid crystal display panel.

The liquid crystal display panel arranges liquid crystal cells in a matrix to control the light transmittance in accordance with pixel signals, thereby displaying a picture.

The driving circuit includes a gate driver for driving gate lines of the liquid crystal display panel, a data driver for driving the data lines, a timing controller for controlling the driving timing of the gate driver and the data driver, and a power supply for supplying power signals required for driving the liquid crystal display panel and the driving circuit.

The data driver and the gate driver are separated into a multiple drive integrated circuits (IC's). Each of the integrated drive IC's is mounted in an opened IC area of a tape carrier package (TCP) or in a base film of the TCP by a chip-on-film (COF) system, to thereby be connected to the liquid crystal display panel by a tape automated bonding (TAB) system. Alternatively, the drive IC may be directly mounted onto the liquid crystal display panel by using a chip-on-glass (COG) system. The timing controller and the power supply are mounted onto a main printed circuit board (PCB).

The drive IC's connected to the liquid crystal display panel by the TAB system are connected, via the TCP, a sub-FCB (i.e., a gate PCB and a data PCB) and a flexible printed circuit (FPC), to the timing controller and the power supply on the main PCB.

The drive IC's mounted onto the liquid crystal display panel by the COG system are connected, via line-on-glass (LOG) type signal lines provided at the FPC and the liquid crystal display panel, to the timing controller and the power supply on the main PCB.

When the drive IC's are connected, via the TCP, to the liquid crystal display panel, the LCD adopts the LOG-type signal lines to reduce the number of PCB's to thereby have a thinner width. Particularly, the gate PCB (which delivers a relatively small number of signals) is removed, and a multiplicity of signal lines for applying gate control signals and power signals to the gate drive IC's are provided on the LOG-type liquid crystal display panel. Thus, the gate drive IC's mounted in the TCP receives the control signals from the timing controller and the power signals from the power supply by way of the main PCB, FPC, the data PCB, the data TCP, the LOG-type signal lines and the gate TCP in turn. In this case, the gate control signals and the gate power signals applied to the gate drive IC's are distorted by line resistances of the LOG-type signal lines, and this distortion results in quality deterioration of the picture displayed on the liquid crystal display panel.

More specifically, as shown in FIG. 1, a LOG-type LCD removed with the gate PCB includes a data PCB 16, a data TCP 12 mounted with a data driving IC 14 and connected between the data PCB 16 and a liquid crystal display panel 6, and a gate TCP 8 mounted with a gate driving IC 10 and connected to the liquid crystal display panel 6.

The liquid crystal display panel 6 has a thin film transistor array substrate 2 and a color filter array substrate 4 joined to each other and having a liquid crystal therebetween. Such a liquid crystal display panel 6 includes liquid crystal cells defined at intersections between gate lines GL and data lines DL, each of which has a thin film transistor as a switching device. The thin film transistor applies a pixel signals from the data line DL to the liquid crystal cell in response to a scanning signal from the gate line GL.

The data drive IC 14 connects, via the data TCP 12 and a data pad of the liquid crystal display panel, to the data line DL. The data drive IC 14 converts digital pixel data into an analog pixel signal and applies it to the data line DL. To this end, the data drive IC 14 receives a data control signal and a pixel data from a timing controller (not shown) and a power signal from a power supply (not shown) by way of the data PCB 16.

The gate drive IC 10 connects, via the gate TCP 8 and a gate pad of the liquid crystal display panel 6, to the gate line GL. The gate drive IC 10 sequentially applies a scanning signal having a gate high voltage VGH to the gate lines GL. Further, the gate drive IC 10 applies a gate low voltage VGL to the gate lines GL in the remaining interval (excluding the time interval when the gate high voltage VGH has been supplied).

To this end, the gate control signals from the timing controller and the power signals from the power supply are applied, via the data PCB 16, to the data TCP 12. The gate control signals and the power signals applied via the data TCP 12 are applied (via a LOG-type signal line group 20 provided at the edge area of the thin film transistor array substrate 2) to the gate TCP 8. The gate control signals and the power signals applied to the gate TCP 8 are inputted, via input terminals of the gate drive IC 10, within the gate drive IC 10. Further, the gate control signals and the power signals are outputted via output terminals of the gate drive IC 10, and are applied, via the gate TCP 8 and the LOG-type signal line group 20, to the gate drive IC 10 mounted in the next gate TCP 8.

The LOG-type signal line group 20 is typically contains signal lines for supplying direct current driving voltages from the power supply, such as a gate low voltage VGL, a gate high voltage VGH, a common voltage VCOM, a ground voltage GND and a base driving voltage VCC. The LOG-type signal line group 20 also supplies gate control signals from the timing controller, such as a gate start pulse GSP, a gate shift clock signal GSC and a gate enable signal GOE.

The LOG-type signal line group 20 is formed in a fine pattern from the same gate metal layer as the gate lines at a specific pad area of the thin film transistor array substrate 2. Thus, the LOG-type signal line group 20 has a larger line resistance than the signal lines on the existing gate PCB. This line resistance distorts gate control signals (i.e., GSP, GSC and GOE) and power signals (i.e., VGH, VGL, VCC, GND and VCOM), thereby causing picture quality deterioration phenomena such as a horizontal line (i.e., gate dim) 32, cross talk in the dot pattern and a greenish hue, etc. as shown in FIG. 2.

FIG. 2 depicts a view for explaining a horizontal line phenomenon caused by the LOG-type signal line group 20.

Referring to FIG. 2, the LOG-type signal line group 20 contains a first LOG-type signal line group LOG1 connected to an input terminal of a first gate TCP 8. A second LOG-type signal line group LOG2 connects to an input terminal of a second gate TCP 9. A third LOG-type signal line group LOG3 connects to an input terminal of a third gate TCP 13. The first to third LOG-type signal line groups LOG1 to LOG3 have line resistances aΩ, bΩ and cΩ proportional to the line length thereof, respectively. The first to third LOG-type signal line groups LOG1 to LOG3 are also connected, via the gate TCP's 8, 9 and 13, to each other in series.

The first gate drive IC 10 is thus supplied with gate control signals GSP, GSC and GOE and power signals VGH, VGL, VCC, GND and VCOM voltage-dropped by the line resistance aΩ of the first LOG-type signal line group LOG1. The second gate drive IC 11 is thus supplied with those voltage-dropped by the line resistances aΩ+bΩ of the first and second LOG-type signal line groups LOG1 and LOG2, and the third gate drive IC 15 is supplied with those voltage-dropped by the line resistances aΩ+bΩ+cΩ of the first to third LOG-type signal line groups LOG1 to LOG3.

A voltage difference is accordingly generated among gate signals VG1 to VG3 applied to the gate lines of first to third horizontal blocks A to C driven with different gate drive IC's 10, 11 and 15, thereby causing horizontal lines 32 among the first to third horizontal line blocks A to C.

FIG. 3 shows a gate signal waveform applied to a certain gate line GLi included in the liquid crystal display panel shown in FIG. 1.

The certain gate line GLi must maintain a gate low voltage VGL except for a horizontal period Hi when it arrives at a sequence to be scanned and thus is supplied with a gate high voltage VGH. However, the gate low voltage VGL supplied to the gate line GLi (owing to a parasitic capacitance between the gate line GLi and the data line DL crossing each other while having a gate insulating film therebetween) is swung in response to a pixel signal applied to the data line DL, and becomes unstable. For example, the gate low voltage VGL is alternately swung towards positive polarity and negative polarity every horizontal period in accordance with an average value of pixel signals applied to one horizontal line, while alternating positive and negative polarities in response to a dot inversion system. Such a swing phenomenon of the gate low voltage VGL is generated similarly at other gate lines to which the gate low voltage VGL is commonly applied via the LOG-type signal lines LOG1, LOG2 and LOG3 of the gate drive IC's 10, 11 and 15, respectively.

The unstable gate low voltage VGL caused by the parasitic capacitance can be stabilized more rapidly as the load amount (i.e., a capacitor and a resistor) applied thereto becomes smaller. However, as the gate low voltage VGL is commonly applied to other gate lines GL, the unstable gate low voltage VGL fails to rapidly stabilize because the value of the parasitic capacitance associated with the gate low voltage VGL increases, and the LOG resistance value becomes large.

Accordingly, the unstable gate low voltage VGL varies the pixel voltage via a storage capacitor Cst provided between the pixel electrode and the pre-stage gate line. As a result, when a specific dot pattern is displayed by a dot inversion system, one encounters the problem of a greenish phenomenon in which a green (G) pixel having the polarity opposite to adjacent red (R) and blue (B) pixels is observed at a relatively large brightness to cause deterioration of the picture quality. Furthermore, when a window pattern is displayed by a dot inversion system, one observes a problem of horizontal cross talk in which a peripheral area adjacent to the window pattern in a horizontal direction is observed at a relatively large brightness, thereby causing deterioration of the picture quality.

SUMMARY OF THE INVENTION

Accordingly, it is an object of the invention to provide a method and apparatus for driving a liquid crystal display panel that minimizes deterioration of picture quality caused by a variation in a gate low voltage.

Another object of the invention is to provide a method and apparatus for driving a liquid crystal display panel that is adapted to minimize deterioration of picture quality caused by a variation in the resistance component of an LOG-type signal line.

The invention, in part, pertains to a driving apparatus for a liquid crystal display panel, having a liquid crystal cell matrix defined by intersections between gate lines and data lines, that includes a gate driver for applying a gate high voltage to the gate lines in a corresponding first period, a first gate low voltage independent from other gate lines to the gate lines in the next second period and a second gate low voltage depending on other gate lines to the gate lines in the next third period.

The driving apparatus can further include a power source for generating and supplying the gate high voltage and for generating a gate low voltage to supply it, via first and second transmission lines connected in parallel to each other, as the first and second gate low voltages.

In the driving apparatus, the first and second gate low voltage can be set to the same level.

The driving apparatus can further include a power source for generating and supplying the gate high voltage and for generating and voltage-dividing a basic gate low voltage to supply it, via first and second transmission lines, as the first and second gate low voltages.

Also, the first gate low voltage can be set to be larger or smaller than the second gate low voltage.

The gate driver applies the first gate low voltage only to the corresponding gate line in at least one horizontal period after the gate high voltage was supplied.

The first and second gate low voltages are applied, via different line on glass (LOG) type signal lines provided at the liquid crystal display panel, to the gate driver.

Each of the liquid crystal cells includes a storage capacitor provided at an overlapping portion between a pixel electrode included therein and a pre-stage gate line.

The invention, in part, pertains to a driving apparatus for a liquid crystal display panel, having a liquid crystal cell matrix defined by intersections between gate lines and data lines, that includes the liquid crystal cells each having a storage capacitor provided at an overlapping portion between a pixel electrode thereof and a pre-stage gate line; and a gate driver for applying a first gate low voltage independent from other gate lines to the pre-stage gate line in a time interval when a storage voltage of the storage capacitor is determined.

In the driving apparatus, the gate driver applies a gate high voltage to the pre-stage gate line in a corresponding scan period, and applies a second gate low voltage depending on other gate lines to the pre-stage gate line in the remaining period excluding a time interval when the gate high voltage and the first gate low voltage are supplied.

The driving apparatus further includes a power source for generating and supplying the gate high voltage and for generating a gate low voltage to supply it, via first and second transmission lines connected in parallel to each other, as the first and second gate low voltages having the same level.

The driving apparatus can further include a power source fot generating and supplying the gate high voltage and for generating and voltage-dividing a basic gate low voltage to supply it, via first and second transmission lines, as the first and second gate low voltages having a different level.

Herein, the first and second gate low-voltages are applied, via different line on glass (LOG) type signal lines provided at the liquid crystal display panel, to the gate driver.

The time interval when the storage voltage of the storage capacitor is determined is a time interval when a pixel voltage is charged in the corresponding liquid crystal cell.

The invention, in part, pertains to a method of driving a liquid crystal display panel, having a liquid crystal cell matrix defined by intersections between gate lines and data lines, that includes the steps of applying a gate high voltage to each of the gate lines in a corresponding first period; applying a first gate low voltage independent from other gate lines to each of the gate lines in the next second period; and applying a third gate low voltage depending on other gate lines to each of the gate lines in the next third period.

The method can further include the steps of generating and supplying the gate high voltage; and generating a gate low voltage to supply it, via first and second transmission lines connected in parallel to each other, as the first and second gate low voltages.

In the inventive method, the first and second gate low voltage can be set to the same level.

The method can further include the steps of generating and supplying the gate high voltage; and generating and voltage-dividing a basic gate low voltage to supply it, via first and second transmission lines, as the first and second gate low voltages.

Herein, the first gate low voltage can be set to be larger or smaller than the second gate low voltage.

The first gate low voltage is applied only to the corresponding gate line in at least one horizontal period after the gate high voltage was supplied.

The first and second gate low voltages can be applied via different line on glass (LOG) type signal lines provided at the liquid crystal display panel.

The invention, in part, pertains to a method of driving a liquid crystal display panel having a liquid crystal cell matrix defined by intersections between gate lines and data lines, each of which has a storage capacitor provided at an overlapping portion between a pixel electrode thereof and a pre-stage gate line, that includes a step of applying a first gate low voltage independent from other gate lines to the pre-stage gate line in a time interval when a storage voltage of the storage capacitor is determined.

The method can further include the steps of applying a gate high voltage to the pre-stage gate line in a corresponding scan period; and applying a second gate low voltage depending on other gate lines to the pre-stage gate line in the remaining period excluding a time interval when the gate high voltage and the first gate low voltage are supplied.

The method can further include the steps of generating and supplying the gate high voltage; and generating a gate low voltage to supply it, via first and second parallel connected transmission, as the first and second gate low voltages having the same level.

The method can further include the steps of generating and supplying the gate high voltage; and generating and voltage-dividing a basic gate low voltage to supply it, via first and second transmission lines, as the first and second gate low voltages having a different level.

Herein, the first and second gate low voltages are applied via different line on glass (LOG) type signal lines provided at the liquid crystal display panel.

The time interval when the storage voltage of the storage capacitor is determined is a time interval when a pixel voltage is charged in the corresponding liquid crystal cell.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention. The drawings illustrate embodiments of the invention and together with the description serve to explain the principles of the embodiments of the invention.

These and other objects of the invention will be apparent from the following detailed description of the embodiments of the present invention with reference to the accompanying drawings.

DETAILED DESCRIPTION

Advantages of the present invention will become more apparent from the detailed description given herein after. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
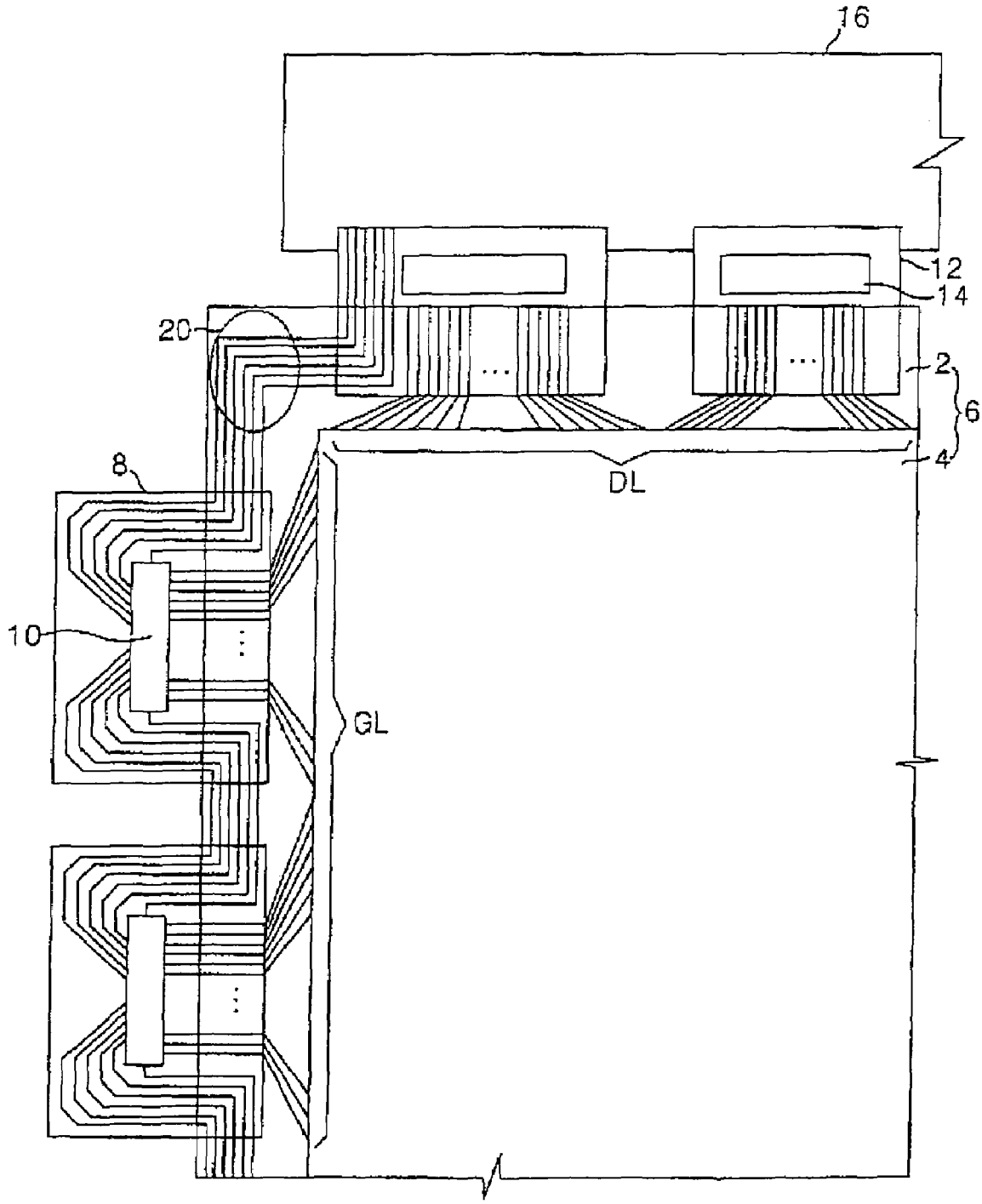
FIG. 1 RELATED ART
FIG. 1 shows a schematic plan view showing a configuration of a related art line-on-glass (LOG) type liquid crystal display.
Figure 2:
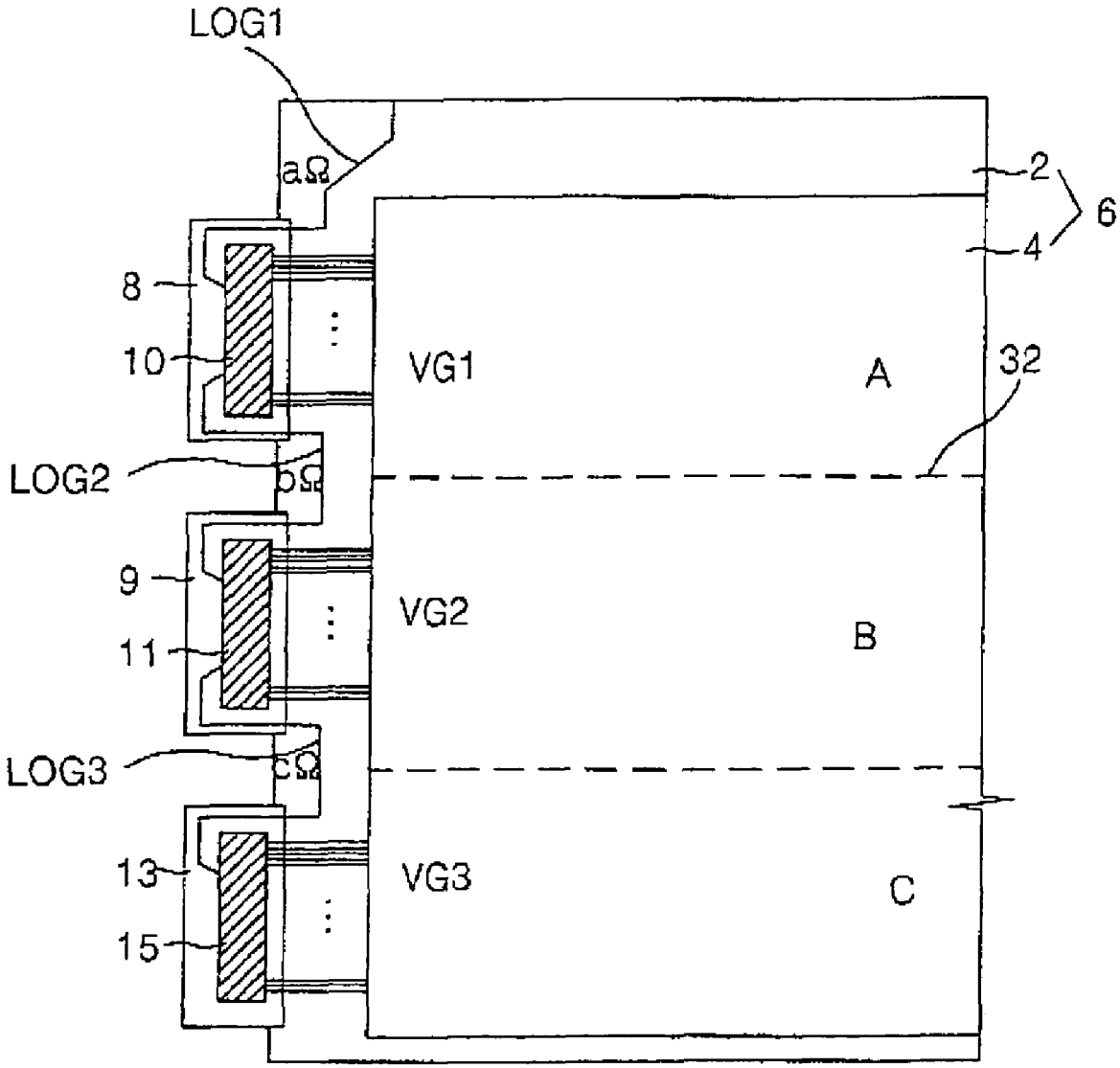
FIG. 2 RELATED ART
FIG. 2 shows a view for explaining a horizontal line phenomenon in the related art liquid crystal display panel shown in FIG. 1.
Figure 3:
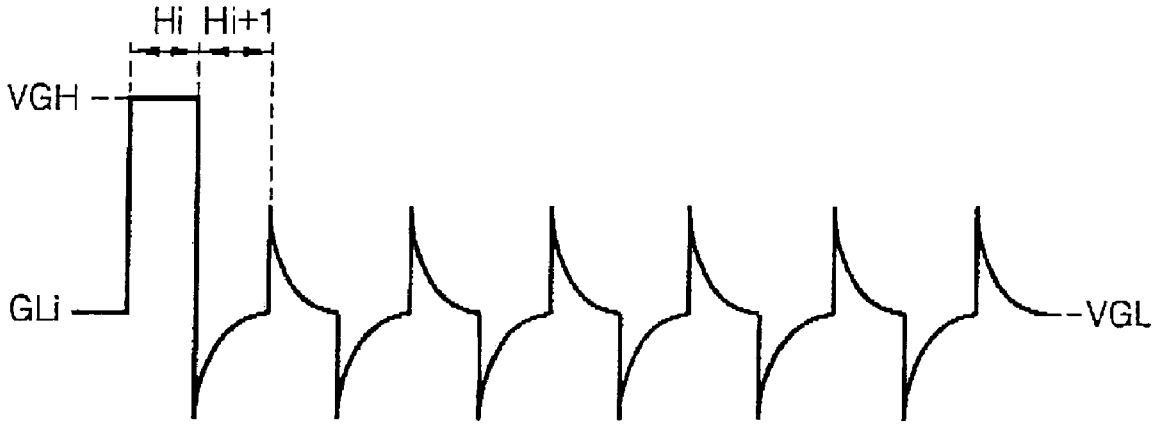
FIG.3 RELATED ART
FIG. 3 shows a related art waveform diagram of a gate signal applied to a certain gate line shown in FIG. 1.
Figure 4:
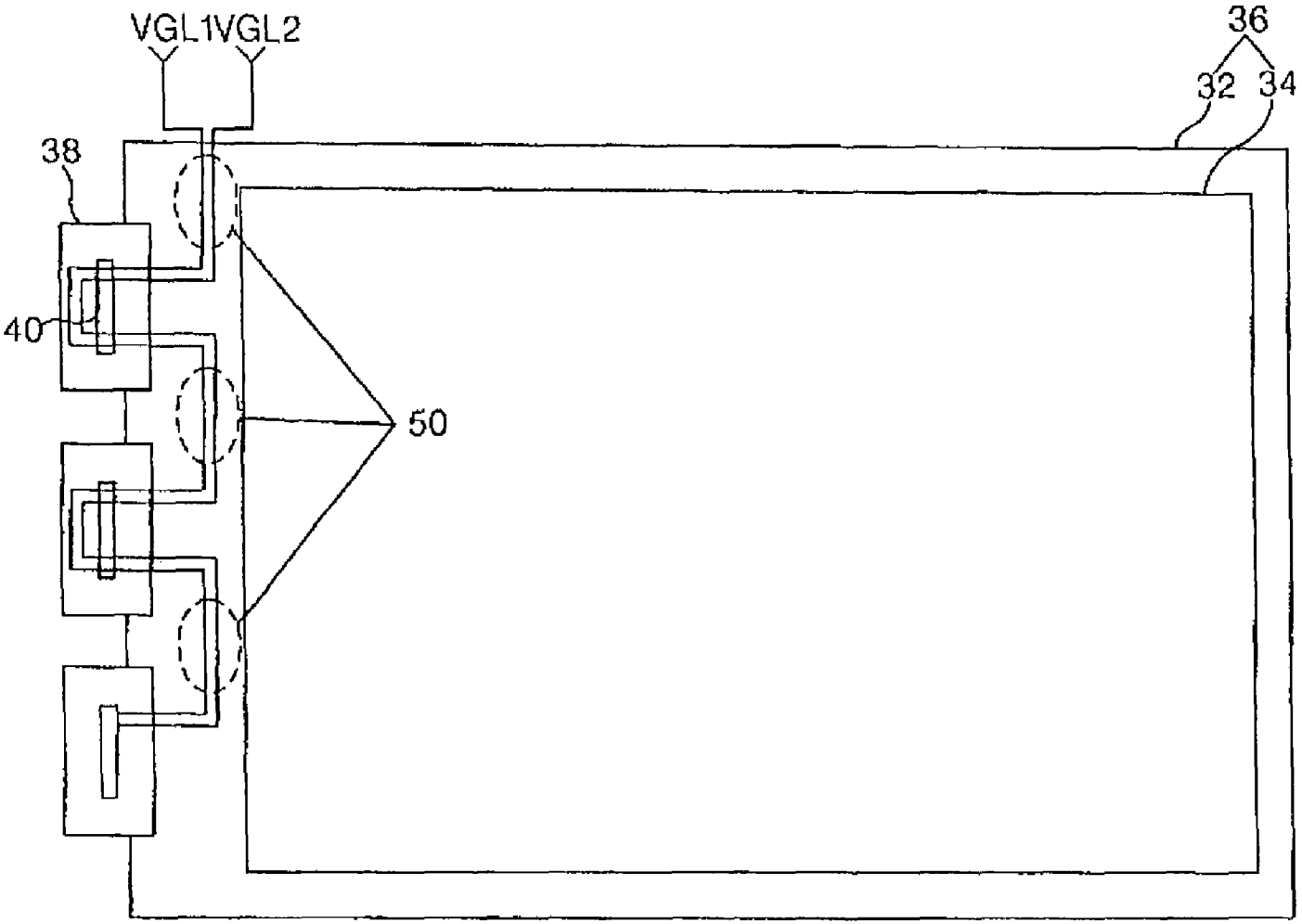
FIG. 4 shows a schematic plan view depicting a configuration of a liquid crystal display device according to an embodiment of the invention.

FIG. 4 schematically shows a driving apparatus for a liquid crystal display panel according to an embodiment of the invention.

Referring to FIG. 4, the driving apparatus for the liquid crystal display panel includes a gate drive IC 40 connected via gate lines of a liquid crystal display panel 36 and a gate TCP 38.

The liquid crystal display panel 36 has a thin film transistor array substrate 32 and a color filter array substrate 34 joined to each other and having a liquid crystal therebetween. The liquid crystal display panel 36 includes liquid crystal cells defined at intersections between gate lines GL and data lines DL, each of which has a thin film transistor as a switching device. The thin film transistor applies a pixel signals from the data line to the liquid crystal cell in response to a scanning signal from the gate line.

The gate drive IC 40 connects, via the gate TCP 38, to the gate line of the liquid crystal display panel 36. The gate drive IC 40 is supplied with gate control signals from a timing controller (not shown) and power signals from a power supply (not shown). More specifically, the gate control signals and the power signals from the exterior are inputted within the gate drive IC 40 by way of a LOG-type signal line group 50 provided at the edge area of the thin film transistor array substrate 32 and the gate TCP 38. Further, the gate control signals and the power signals are outputted via output terminals of the gate drive IC 40, and then applied (via the gate TCP 38 and the LOG-type signals line group 50) to the gate drive IC 40 mounted in the next gate TCP 38.

Figure 5:
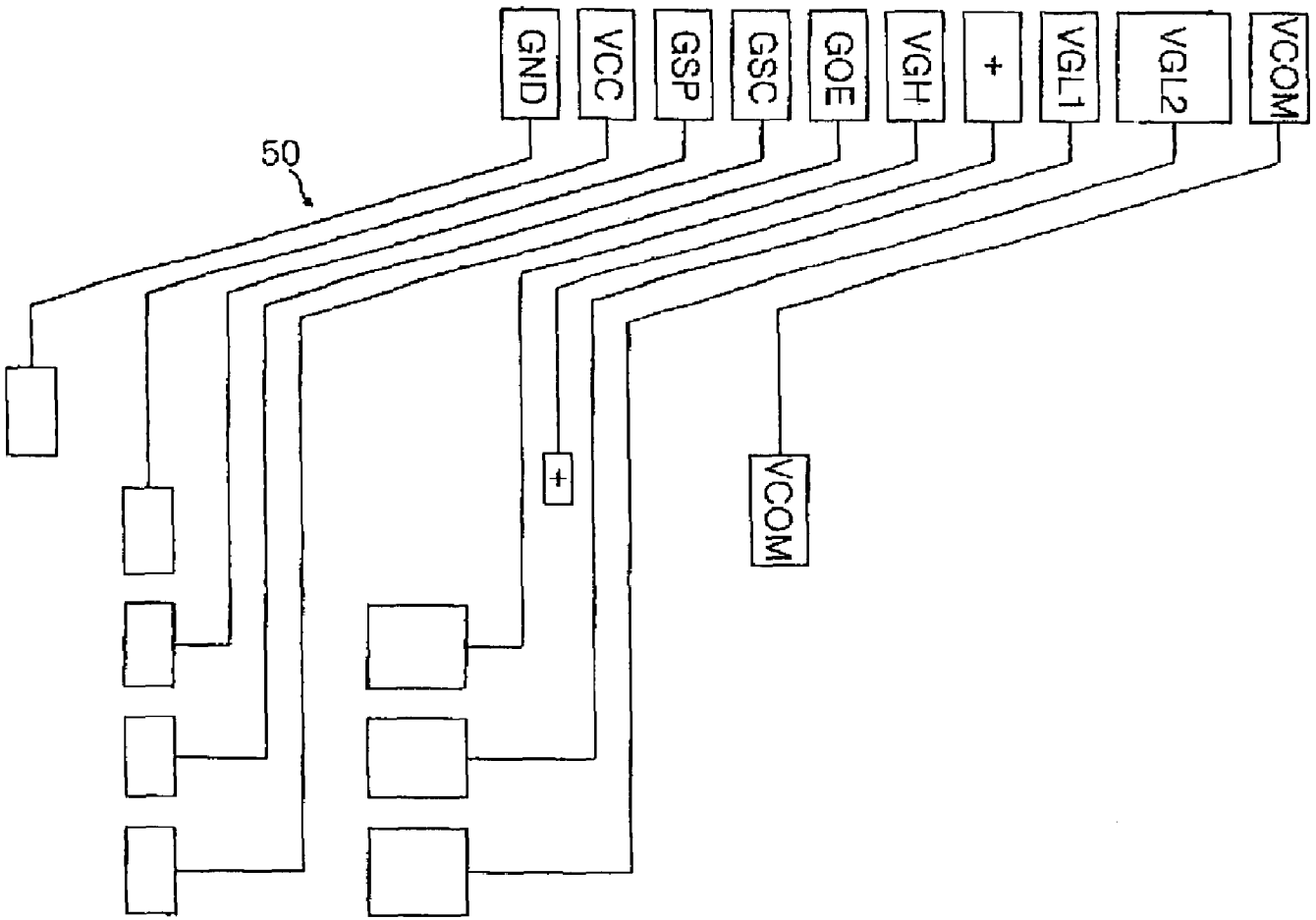
FIG. 5 shows a detailed configuration view of the LOG-type signal line group shown in FIG. 4.

The LOG-type signal line group 50 typically contains signal lines for supplying direct current driving voltages from the power supply, such as first and second gate low voltages VGL1 and VGL2, a gate high voltage VGH, a common voltage VCOM, a ground voltage GND and a base driving voltage VCC. The signal lines also supply gate control signals from the timing controller, such as a gate start pulse GSP, a gate shift clock signal GSC and a gate enable signal GOE. See FIG. 5. Particularly, the LOG-type signal line group 50 supplies the first and second gate low voltages VGL1 and VGL2 via different LOG-type signal lines as shown in FIG. 4 and FIG. 5.

The gate drive IC 40 includes a shift register and a level shifter. The shift register sequentially shifts the gate start pulse GSP in response to the gate shift clock signal GSC to output it. The level shifter outputs the gate high voltage VGH to the corresponding gate line in the corresponding scan period, and the level shifter sequentially outputs the first and second gate low voltages VGL1 and VGL2 to the corresponding gate line in the remaining period in response to an output signal of the shift register. In this case, the gate output enable signal GOE controls a time interval when the gate high voltage VGH is outputted via the level shifter.

Figure 6:
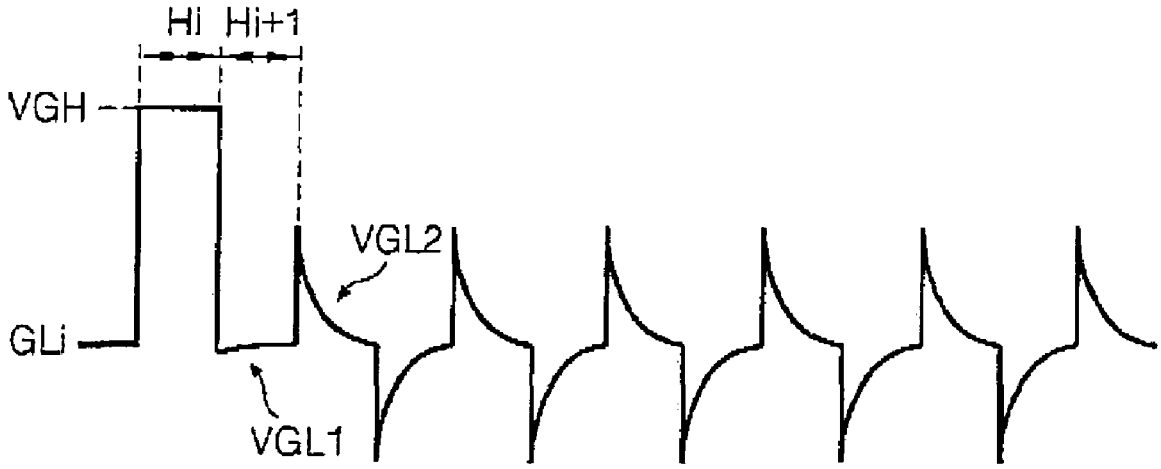
FIG. 6 depicts a waveform diagram of a gate signal applied to a certain gate line in the liquid crystal display panel shown in FIG. 4.

More specifically, a gate signal is applied from the gate drive IC 40 to the ith gate line Gli, as is shown in FIG. 6. FIG. 6 shows that the gate drive IC 40 applies the gate high voltage VGH to the ith gate line GLi in the ith horizontal period Hi. Further, the gate drive IC 40 applies the first gate low voltage VGL1 to it independently of other gate lines in the following (i+1)th horizontal period Hi+1, and then the gate drive IC 40 applies the second gate low voltage VGL2 to it commonly with other gate lines in a time interval from the next (i+2)th horizontal period Hi+2 until an application of the next gate high voltage VGH.

The first gate low voltage VGL1 is independently applied to the ith gate line GLi in the (i+1)th horizontal period Hi+1, and the capacitance value of a parasitic capacitor (i.e., a parasitic capacitor between the gate line and the data line) loaded on the first gate low voltage VGL1 reduces dramatically. Thus, a pixel signal applied to the data line has virtually no influence on the first gate low voltage VGL1, even though a LOG resistance exists, and the pixel signal can be stably applied to the ith gate line GLi. Accordingly, a pixel voltage can be charged in the (i+1)th horizontal period Hi+1, and a stable storage voltage can be charged in the liquid crystal cells in the (i+1)th horizontal line at which a storage voltage of the storage capacitor is determined in response to the stable first gate low voltage VGL1. As a result, the storage capacitor minimizes pixel voltage variation owing to the application of stable storage voltage, thereby minimizing the deterioration of picture quality through phenomena such as a greenish hue, horizontal cross talk, etc.

Furthermore, the storage voltage has almost no influence over the unstable second gate low voltage VGL2 applied commonly to other gate lines from the (i+2)th horizontal period Hi+2 until an application of the next gate high voltage VGH. Deterioration of picture quality caused by the unstable second gate low voltage VGL2 can therefore be minimized.

Also, the first and second gate low voltages VGL1 and VGL2 applied to the liquid crystal display panel shown in FIG. 4 may be set to have either the same level or a different level.

Figure 7:
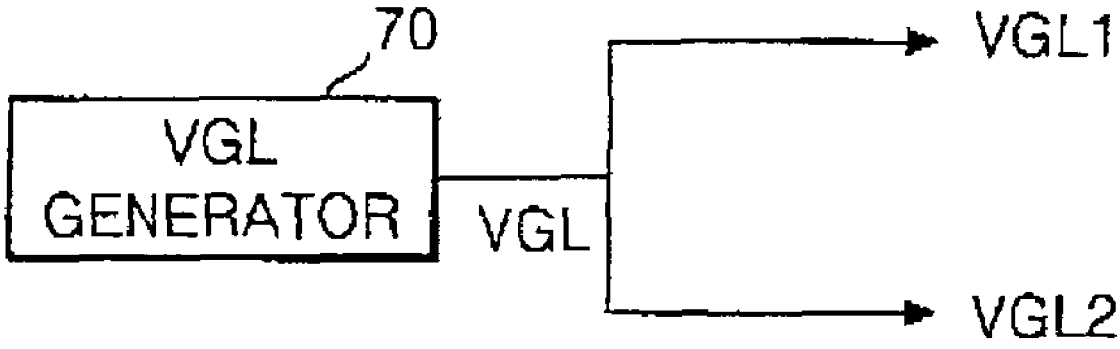
FIG. 7 depicts a block diagram showing a configuration of a gate low voltage generator for supplying first and second gate low voltages shown in FIG. 4.

FIG. 7 shows the first and second gate low voltages VGL1 and VGL2 being set to the same level and are supplied from a gate low voltage generator 70. The gate low voltage generator 70 shown in FIG. 7 generates and outputs a gate low voltage VGL. The output gate low voltage VGL is applied, via first and second transmission lines separated in parallel, from the output terminal of the gate low voltage generator 70 to the liquid crystal display panel shown in FIG. 4 as the first and second gate low voltages VGL1 and VGL2.

Figure 8:
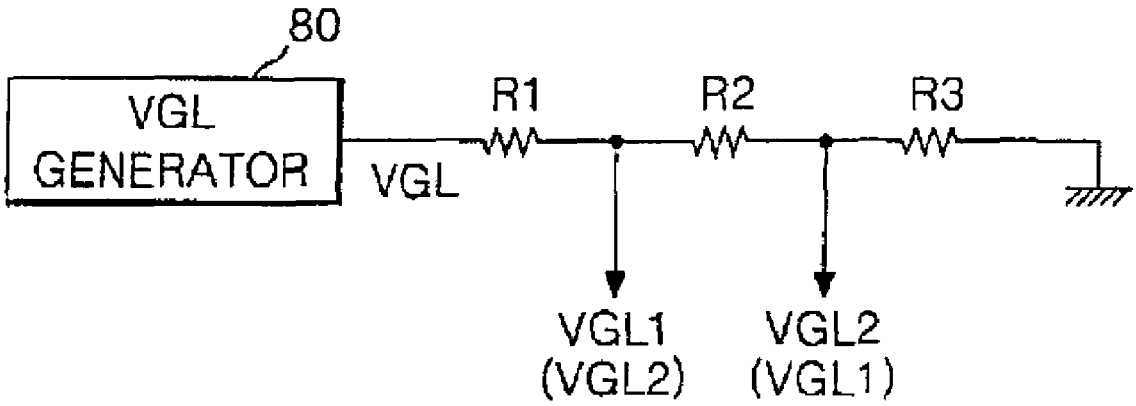
FIG. 8 shows a block circuit diagram showing a configuration of another gate low voltage generator for supplying first and second gate low voltages shown in FIG. 4.

On the other hand, the first and second gate low voltages VGL1 and VGL2 set to a different level are supplied from a gate low voltage generator 80, as shown in FIG. 8. The gate low voltage generator 80 shown in FIG. 8 generates and outputs a basic gate low voltage VGL. The output basic gate low voltage VGL is voltage-divided at the output terminal of the gate low voltage generator 80, and the basic gate low voltage VGL is then applied, via the first and second transmission lines, to the liquid crystal display panel shown in FIG. 4 as the first and second gate low voltage VGL1 and VGL2. For example, the first and second gate low voltages VGL1 and VGL2 are generated via voltage-division nodes among first to third resistors R1 to R3 connected, in series, to the output terminal supplied with the basic gate low voltage VGL. Specifically, the first gate low voltage VGL1 generates via the voltage-division node between the first and second resistors R1 and R2, and the second gate low voltage VGL2 generates via the voltage-division node between the second and third resistors R2 and R3. In contrast, the second gate low voltage VGL2 may be generated via the voltage-division node between the first and second resistors R1 and R2, and the first gate low voltage VGL1 may be generated via the voltage-division node between the second and third resistors R2 and R3. Such first and second gate low voltages VGL1 and VGL2 are determined by the following equation:

$$VGL1(\text{or } VGL2)=VGL*(R2+R3)/(R1+R2+R3)*VGL$$

$$VGL2(\text{or } VGL1)=VGL2*R3/(R1+R2+R3) \quad (1)$$

It can be seen from the above equation that the first gate low voltage VGL1 should be set to have a larger value or a smaller value than the second gate low voltage VGL2.

As described above, according to the invention, the first gate low voltage independent from other gate lines is applied to the pre-stage gate line in a time interval when the storage voltage is determined, thereby charging a stable storage voltage into the storage capacitor. Accordingly, an application of the stable storage voltage to the storage capacitor can minimize the pixel voltage variation in the liquid crystal cell, thereby minimizing the deterioration of picture quality including phenomena such as a horizontal line, a greenish hue and a horizontal cross talk, etc. while adopting the LOG-type signal line.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a liquid crystal display panel including a liquid crystal cell matrix defined by intersections between gate lines and data lines, said apparatus comprising:

a gate driver for applying a gate high voltage to one of the gate lines in a first scan period, applying a first gate low voltage to the one of the gate lines independent from the other gate lines in a second scan period immediately following the first scan period, and applying a second gate low voltage to the one of the gate lines immediately after the second scan period until next application of the gate high voltage to the one of the gate lines, wherein the first scan period and the second scan period have a substantially same time length, wherein the gate high voltage and the first and second gate low voltages are applied, via different line on glass (LOG) signal lines, to the gate driver, and wherein the line on glass signal lines are arranged on the liquid crystal display panel and connect adjacent gate drivers to each other.

2. The driving apparatus according to claim 1, further comprising:

a power source for generating and supplying said gate high voltage and for generating a gate low voltage to supply it, via parallel connected first and second transmission lines, as said first and second gate low voltages.

3. The driving apparatus according to claim 1, wherein said first and second gate low voltage are set at about the same level.

4. The driving apparatus according to claim 1, further comprising:

a power source for generating and supplying said gate high voltage and for generating and voltage-dividing a basic gate low voltage to supply said basic gate low voltage, via first and second transmission lines, as said first and second gate low voltages.

5. The driving apparatus according to claim 1, wherein said first gate low voltage is set to be larger or smaller than said second gate low voltage.

6. The driving apparatus according to claim 1, wherein said gate driver applies said first gate low voltage only to the corresponding gate line in at least one horizontal period after said gate high voltage was supplied.

7. The driving apparatus according to claim 1, wherein each of the liquid crystal cells includes:

a storage capacitor provided at an overlapping portion between a pixel electrode and a pre-stage gate line.

8. A driving apparatus for a liquid crystal display panel including a liquid crystal cell matrix defined by intersections between gate lines and data lines, said apparatus comprising:

a storage capacitor provided at an overlapping portion between a pixel electrode thereof and a pre-stage gate line of the liquid crystal cells; and a gate driver for applying a gate high voltage to the pre-stage gate line in a first scan period, applying a first gate low voltage to said pre-stage gate line independent from other gate lines in a second scan period immediately following the first scan period when a storage voltage of the storage capacitor is determined, and applying a second gate low voltage to the pre-stage gate line immediately after the second scan period until next application of the gate high voltage to the pre-stage gate line, wherein the first scan period and the second scan period have a substantially same time length, wherein the gate high voltage and the first and second gate low voltages are applied, via different line on glass (LOG) signal lines, to the gate driver, and wherein the line on glass signal lines are arranged on the liquid crystal display panel and connect adjacent gate drivers to each other.

9. The driving apparatus according to claim 8, further comprising:

a power source for generating and supplying said gate high voltage and for generating a gate low voltage to supply it, via first and second parallel connected transmission lines, as said first and second gate low voltages having the same level.

10. The driving apparatus according to claim 8, further comprising:

a power source for generating and supplying said gate high voltage and for generating and voltage-dividing a basic gate low voltage to supply it, via first and second transmission lines, as said first and second gate low voltages having a different level.

11. The driving apparatus according to claim 8, wherein said second scan period is when a pixel voltage is charged in the corresponding liquid crystal cell.

12. A method of driving a liquid crystal display panel including a liquid crystal cell matrix defined by intersections between gate lines and data lines, said method comprising the steps of:

applying a gate high voltage from gate drivers to one of the gate lines in a first scan period;

applying a first gate low voltage from the gate drivers to the one of the gate lines independent from the other gate lines in a second scan period immediately following the first scan period; and applying a second gate low voltage from the gate drivers to the one of the gate lines immediately after the second scan period until next application of the gate high voltage to the one of the gate lines, wherein the first scan period and the second scan period have a substantially same time length, wherein the gate high voltage and the first and second gate low voltages are applied, via different line on glass (LOG) signal lines, to the gate driver, and wherein the line on glass signal lines are arranged on the liquid crystal display panel and connect adjacent gate drivers to each other.

13. The method according to claim 12, further comprising the steps of:

generating and supplying said gate high voltage; and generating a gate low voltage to supply it, via first and second parallel connected transmission lines, as said first and second gate low voltages.

14. The method according to claim 13, wherein said first and second gate low voltages are set to the same level.

15. The method according to claim 12, further comprising the steps of:

generating and supplying said gate high voltage; and generating and voltage-dividing a basic gate low voltage to supply it, via first and second transmission lines, as said first and second gate low voltages.

16. The method according to claim 15, wherein said first gate low voltage is set to be larger or smaller than said second gate low voltage.

17. The method according to claim 15, wherein said first gate low voltage is applied only to the corresponding gate line in at least one horizontal period after said gate high voltage was supplied.

18. A method of driving a liquid crystal display panel including a liquid crystal cell matrix defined by intersections between gate lines and data lines, each of which has a storage capacitor provided at an overlapping portion between a pixel electrode thereof and a pre-stage gate line, said method comprising the step of:

applying a gate high voltage from gate drivers to the pre-stage gate line in a first scan period;

applying a first gate low voltage from the gate drivers to said pre-stage gate line independent from other gate lines in a second scan period immediately following the first scan period when a storage voltage of the storage capacitor is determined; and applying a second gate low voltage from the gate drivers to the pre-stage gate line immediately after the second scan period until next application of the gate high voltage to the pre-stage gate line, wherein the first scan period and the second scan period have a substantially same time length, wherein the gate high voltage and the first and second gate low voltages are applied, via different line on glass (LOG) signal lines, to the gate driver, and wherein the line on glass signal lines are arranged on the liquid crystal display panel and connect adjacent gate drivers to each other.

19. The method according to claim 18, further comprising the steps of:

generating and supplying said gate high voltage; and generating a gate low voltage to supply it, via first and second parallel connected transmission lines, as said first and second gate low voltages having the same level.

20. The method according to claim 18, further comprising the steps of:

generating and supplying said gate high voltage; and generating and voltage-dividing a basic gate low voltage to supply it, via first and second transmission lines, as said first and second gate low voltages having a different level.

21. The method according to claim 18, wherein said second scan period is when a pixel voltage is charged in the corresponding liquid crystal cell.

* * * * *